US006241102B1

(12) United States Patent
Lindberg et al.

(10) Patent No.: US 6,241,102 B1
(45) Date of Patent: Jun. 5, 2001

(54) SCREENING DEVICE

(75) Inventors: Erkki Lindberg; Tauno Laakso, both of Valkeakoski (FI)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/581,811

(22) PCT Filed: Nov. 17, 1998

(86) PCT No.: PCT/SE98/02064

§ 371 Date: Jun. 16, 2000

§ 102(e) Date: Jun. 16, 2000

(87) PCT Pub. No.: WO99/32711

PCT Pub. Date: Jul. 1, 1999

(30) Foreign Application Priority Data

Dec. 19, 1997 (FI) ..... 9704808

(51) Int. Cl.[7] ..... B07B 1/20

(52) U.S. Cl. ..... 210/414; 210/415; 209/273; 209/306; 162/55

(58) Field of Search ..... 210/413, 414, 210/415, 433.1; 209/273, 306; 162/55, 251

(56) References Cited

U.S. PATENT DOCUMENTS 3,586,172 * 6/1971 Young ..... 209/273
4,634,521 * 1/1987 Simola et al. ..... 210/413
4,749,474 * 6/1988 Young ..... 209/273
5,232,552 8/1993 Lundberg et al. ..... 162/55
5,358,637 * 10/1994 Hutzler et al. ..... 162/55
5,925,249 * 7/1999 Fredriksson ..... 210/415

FOREIGN PATENT DOCUMENTS 506 602 1/1998 (SE) .
93/23609 11/1993 (WO) .

* cited by examiner

*Primary Examiner*—Christopher Upton
(74) *Attorney, Agent, or Firm*—Lerner, David, Littenberg, Krumholz & Mentlik, LLP

(57) ABSTRACT

Apparatus is disclosed for screening fiber suspensions including a housing, an annular screen disposed within the housing, a rotor disposed within the annular screen for rotating relative to the annular screen, pulsation wings disposed between the outer surface of the rotor and the annular screen for relative rotation with the rotor, an inlet for the fiber suspension to feed the fiber suspension to one end of the screening zone, an accept outlet for a portion of the fiber suspension which passes through the annular screen, a reject outlet for a portion of the fiber suspension which does not pass through the annular screen, and a dilution liquid nozzle for supplying a dilution liquid to the screening zone between the rotor and the annular screen, the dilution liquid nozzle disposed proximate to the reject outlet and directing the dilution liquid into the screening zone along the outer surface of the rotor.

6 Claims, 1 Drawing Sheet

SCREENING DEVICE

FIELD OF THE INVENTION

The present invention relates to a device for screening fiber suspensions, such as pulp suspensions, for dividing the fiber suspension into different length fractions or separating impurities and other pulp fractions undesired for the final product, such as coarse particles, undefibered material and poorly worked fibers.

BACKGROUND OF THE INVENTION

It is known that variations in a concentration of a pulp suspension are of decisive importance for the screening process. A reduction in the concentration implies an increase of the hydraulic load on the screen means, i.e. the flow rate through the orifices in the screen increases. At concentrations below about 0.5% the capacity becomes unacceptably low. An increase in the concentration implies an increase of the energy intensity required for breaking up the fiber network into individual fibers and causes it to become fluid, so-called fluidization, which is a prerequisite for the screening process. The concentration, therefore, sets a limit for efficient utilization of the screen. As a result of too high a concentration, the flocks of the pulp will not be broken up, which implies that the screening process cannot continue.

In a conventional pressurized screen for pulp suspensions, thickening along the length of the screening zone is the physical problem which limits the effectiveness of the screen with regard to both capacity and efficiency. From a physical point of view, the thickening implies that the concentration of the fiber suspension increases from the inlet to the reject outlet along the surface of the screen basket. Increased concentration implies that die strength of the fiber network increases considerably.

Due to the fact that the rotary part of the screen rotates at equal speed along the entire length of the screening zone, the energy supply is substantially constant from the inject end to the reject end of the screen. This implies that the screening must start at too low, a concentration at the beginning of the screening zone, in order to prevent the pulp concentration from rapidly becoming so high that a large portion of the screening zone operates as a thickener. An energy intensity too high in relation to the pulp concentration implies that the fiber suspension is overfluidized at the beginning of the screening zone, which yields an unnecessarily high turbulence level and, as a result, deteriorated separation selectivity. After a short zone with ideal conditions, the pulp concentration will be too high, the energy will no longer be sufficient for breaking up the fiber network, and the final portion of the screening zone operates as a thickener. In other words, the thickening implies that the screen looses efficiency and capacity.

In connection with certain modern pulp screens, one has increased the pulp concentration by providing inside the screen a rotor with pulsation-creating wings, which yield an extended suction pulse producing a vacuum adjacent to the screen, in order to recover a certain amount of the liquid lost by the thickening. At the same time, an overpressure arises on the inside of the pulsation wings. Extended suction pulses by the use of wide pulsation wines renders it possible to increase the concentration in a screen, but at this high a concentration the process, according to the above reasoning, becomes very sensitive from the point of view of optimization. Small variations in the pulp concentration, dewatering properties or fiber length distribution affect the critical balance between network strength and energy supply. As a result, one is forced to operate the screen at a number of revolutions higher than at optimum, in order to manage the operability even during normal process variations. Especially at the end of the screening zone, the effect of the suction pulses tends to diminish, with thickening problems resulting.

In accordance with the present invention, these and other difficulties have been overcome by the invention of apparatus for screening fiber suspensions comprising a housing, an annular screen disposed within the housing, a rotor having an outer surface defining a first end and a second end disposed within the annular screen for rotating relative to the annular screen, pulsation wings disposed between the outer surface of the rotor and the annular screen for relative rotation with the rotor whereby a screening zone having a first end and a second end is formed between the rotor and the annular screen, an inlet for the fiber suspension for feeding the fiber suspension to the first end of the screening zone, an accept outlet for a portion of the fiber suspension which passes through the annular screen, a reject outlet for a portion of the fiber suspension which does not pass through the annular screen, and a dilution liquid nozzle for supplying a dilution liquid to the screening zone, the dilution liquid nozzle disposed proximate to the reject outlet and directing the dilution liquid into the screening zone along the outer surface of the rotor. In a preferred embodiment, the pulsation wings include a first end and a second end and the dilution liquid nozzle is disposed at a height corresponding to the second end of the pulsation wings.

In accordance with one embodiment of the apparatus of the present invention, the dilution liquid nozzle comprises a plurality of the dilution liquid nozzles located circumferentially around the outer surface of the second end of the rotor. Preferably, the apparatus includes a stationary wall member disposed proximate to the second end of the screening zone adjacent to the second end of the rotor, the stationary wall member comprising a portion of the dilution liquid nozzle and forming a gap seal with the second end of the rotor.

In accordance with another embodiment of the apparatus of the present invention, the dilution liquid nozzle includes a gap for the dilution liquid, and the apparatus includes a stationary wall member disposed proximate to the second end of the screening zone adjacent to the second end of the rotor and forming a gap seal with the second end of the rotor, the gap being partially defined by the stationary wall member. In a preferred embodiment, the gap is defined by a space between the stationary wall member and the second end of the rotor.

According to the present invention, the above problems can be reduced substantially by forming the screen with a dilution liquid supply at the reject outlet by means of nozzles directed into the screening zone. The variations in thickening arising under normal conditions can thereby be counteracted effectively, especially during changes in production and quality. It is then possible to increase the ingoing and outgoing concentration of the screen, its capacity and efficiency, and to lower the energy consumption. The dilution liquid supply according to the present invention has the essential advantage that it permits one to drive the screen at a lower number of revolutions.

BRIEF DESCRIPTION OF THE DRAWINGS

The present invention is described in greater detail in the following detailed description, with reference to the accompanying drawing illustrating an embodiment of the present invention, in which.

DETAILED DESCRIPTION

Figure 1:
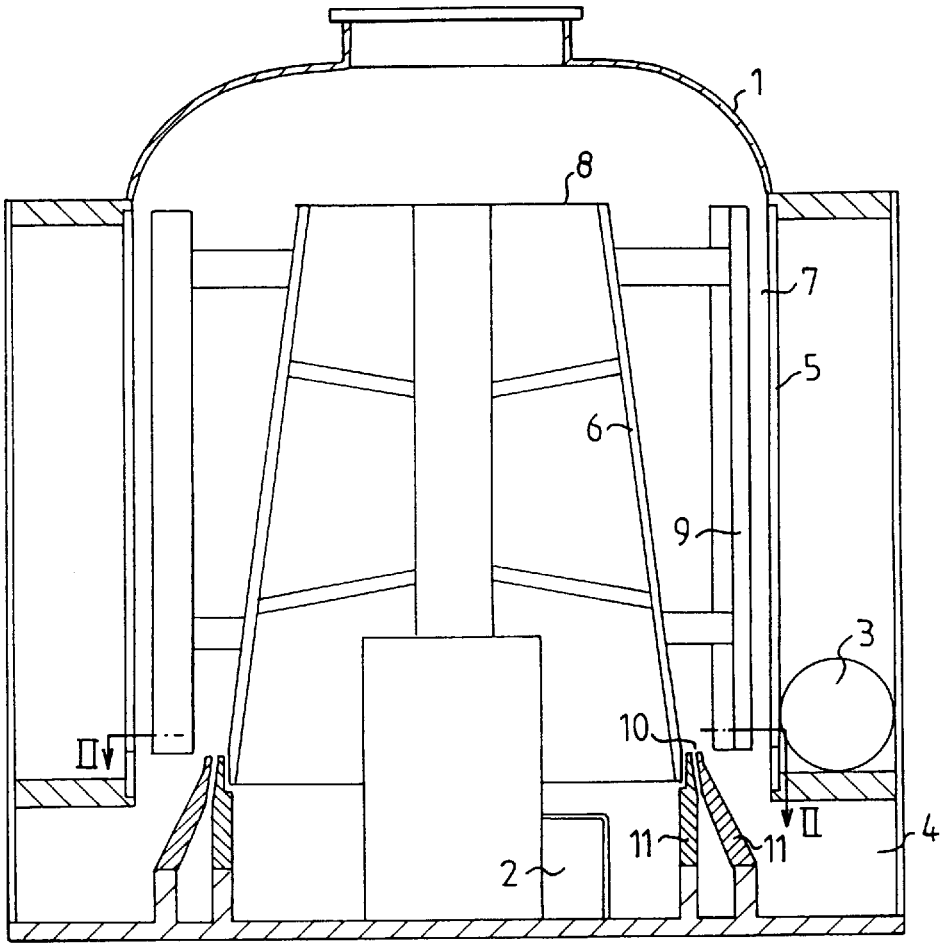
FIG. 1 is a side, elevational, cross-sectional schematic representation of a screening device according to the present invention.

The screening device shown comprises an air-tight casing I with inlet 2 for the pulp suspension (inject) and outlets, 3 and 4, for accept and reject, respectively. In the casing 1 a cylindrical screen 5, preferably with a vertical axis of symmetry, is located at a stationary position. In the screen 5 a rotor 6 is located and extends along the entire screen. The rotor 6 is concentric with respect to the screen means, so that an overall screening zone 7 is formed between the rotor 6 and the screen 5. Alternatively, the screen can be rotary at a speed relative to the rotor 6.

The inject inlet 2 for the pulp suspension is connected to the casing 1 for the supply of pulp from below to the inside of the rotor 6. The rotor is formed as a drum, through which the supplied pulp suspension is intended to flow upward and through one or several openings 8 in the upper portion of the rotor 6 for transferring the pulp to the upper end of the screening zone 7. The rotor is provided on the outside with pulsation wings 9, which extend along the entire screening zone 7. These wings 9 are spaced from the rotor and formed with a leading edge 20 located near the screen 5, and a rear edge 21 located at a greater distance from the screen. The wings 9 thereby produce an extended suction pulse when they move along the screen 5 which keeps the screen open and promotes separation of the accept. The wings 9 can be of the type shown in Swedish Patent Application No. 464, 473. The remaining part of the pulp suspension is moved on to the reject outlet 4.

Due to the separation of liquid from the suspension together with the fibers through the screen means 5, thickening takes place in the direction of flow in the screening zone 7. The pulsation wings 9, due to their design, produce during their rotation an increased pressure and increased concentration inward towards the rotor 6. In order to counteract congestion of the pulp in the lower portion of the screening zone 7 adjacent the rotor 6, a number of stationary nozzles 10 for the supply of dilution liquid are placed at the reject outlet 4 and directed into the screening zone 7 aloniz the surface of the rotor 6. In this manner, an upwardly directed flow adjacent the surface of the rotor 6 is produced. The directed dilution liquid supply, in addition to counteracting thickening of the pulp at the reject outlet, counteracts an unfavorable pressure balance between the front side and rear side of the pulsation wings 9 at the lower end of the wings.

Figure 2:
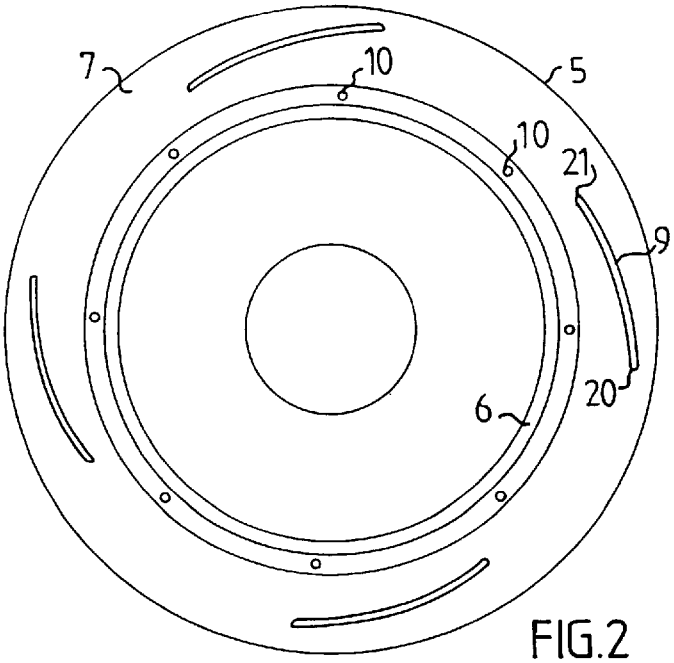
FIG. 2 is a top, elevational, cross-sectional view taken along lines II–11 in FIG. 1.

The nozzles 10 should be uniformly distributed around the rotor 6, and can suitably be about 6 to 12 nozzles, as shown in FIG. 2. They can be directed axially or obliquely into the screening zone 7. The nozzles should be placed on the same level as the lower end of the pulsation wings 9 and preferably on an overall wall element 11, which at the same time forms a gap seal with the rotor 6 for defining the reject outlet 4 from the inside of the rotor.

Figure 3:
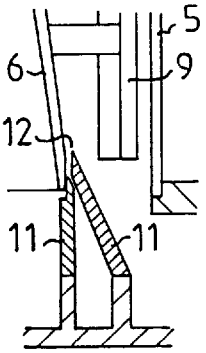
FIG. 3 is a side, elevational, partial detailed view of the screening device of the present invention with an alternative design of the nozzles.

In FIG. 3 an alternative design of the nozzles is shown, in which they consist of an overall gap 12. The gap can be defined between the rotor 6 and stationary wall element 11. In this case the nozzle gap 12 is defined between a movable and a stationary part. This implies, at the same time, that the risk of clogging is reduced.

Pulp to be screened is supplied through the inlet 2 to the inside of the rotor 6 and through the openings 8 in the rotor to the screening zone 7, through which the pulp is moved downward from one end to the other. The accept passes through the screen 5 together with a portion of the liquid, which results in thickening of the reject transported along the screening zone 7. The thickening of the reject is, to a certain extent, counteracted by the pulsation wings 9. Variations in the thickening of the reject are counteracted by a controlled supply of dilution liquid under pressure through the nozzles 10 at the end of the screening zone 7. In addition to counteracting twckening of the reject by dilution, the spraying in of liquid brings about a favorable flow at the reject outlet. The dilution liquid supply is preferably controlled so that the concentration of outgoing reject is held on a desired level.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for screening fiber suspensions comprising a housing, an annular screen disposed within said housing, a rotor having an outer surface defining a first end and a second end disposed within said annular screen for rotating relative to said annular screen, pulsation wings disposed between said outer surface of said rotor and said annular screen for relative rotation with said rotor whereby a screening zone having a first end and a second end is formed between said rotor and said annular screen, an inlet for said fiber suspension for feeding said fiber suspension to said first end of said screening zone, an accept outlet for a portion of said fiber suspension which passes through said annular screen, a reject outlet for a portion of said fiber suspension which does not pass through said annular screen, and a dilution liquid nozzle for supplying a dilution liquid to said screening zone, said dilution liquid nozzle disposed proximate to said reject outlet and directing said dilution liquid into said screening zone along said outer surface of said rotor.

2. The apparatus of claim 1, wherein said pulsation wings include a first end and a second end, and wherein said dilution liquid nozzle is disposed at a height corresponding to said second end of said pulsation wings.

3. The apparatus of claim 1, wherein said dilution liquid nozzle comprises a plurality of said dilution liquid nozzles located circumferentially around said outer surface of said second end of said rotor.

4. The apparatus of claim 3, including a stationary wall member disposed proximate to said second end of said screening zone adjacent to said second end of said rotor, said stationary wall member comprising a portion of said dilution liquid nozzle and forming a gap seal with said second end of said rotor.

5. The apparatus of claim 1, wherein said dilution liquid nozzle includes a gap for said dilution liquid, and including a stationary wall member disposed proximate to said second end of said screening zone adjacent to said second end of said rotor and forming a gap seal with said second end of said rotor, said gap being partially defined by said stationary wall member.

6. The apparatus of claim 5, wherein said gap is defined by a space between said stationary wall member and said second end of said rotor.

* * * * *